United States Patent [19]

Palac et al.

[11] Patent Number: 4,652,791

[45] Date of Patent: Mar. 24, 1987

[54] COLOR CATHODE RAY TUBE AND TENSIBLE SHADOW MASK BLANK FOR USE THEREIN

[75] Inventors: Kazimir Palac, Carpentersville; Charles J. Prazak, III, Elmhurst; Paul Strauss, Chicago, all of Ill.

[73] Assignee: Zenith Electronics Corporation, Glenview, Ill.

[21] Appl. No.: 729,020

[22] Filed: Apr. 30, 1985

[51] Int. Cl.[4] ..... H01J 9/18

[52] U.S. Cl. ..... 313/402; 313/407; 445/30

[58] Field of Search ..... 313/402, 407, 404, 408; 445/30, 37

[56] References Cited

U.S. PATENT DOCUMENTS

| | | | |
|---|---|---|---|
| 2,625,734 | 1/1953 | Law . | |
| 2,654,940 | 10/1953 | Law . | |
| 2,761,990 | 9/1956 | Amdursky et al. . | |
| 2,842,696 | 7/1958 | Fischer-Colbrie . | |
| 3,390,447 | 7/1968 | Mears . | |
| 3,440,469 | 4/1969 | Bradu et al. . | |
| 3,638,063 | 1/1972 | Tachikawa et al. | 313/348 |
| 3,873,874 | 3/1975 | Shinal | 313/402 |
| 3,894,321 | 7/1975 | Moore | 313/402 X |
| 4,069,567 | 1/1978 | Schwartz . | |
| 4,495,437 | 1/1985 | Kume et al. | 313/403 |
| 4,547,696 | 10/1985 | Strauss | 313/407 |

FOREIGN PATENT DOCUMENTS

| | | | |
|---|---|---|---|
| 52-57776 | 5/1977 | Japan | 313/402 |
| 1163495 | 9/1969 | United Kingdom . | |

*Primary Examiner*—Michael J. Tokar
*Assistant Examiner*—Joseph W. Roskos
*Attorney, Agent, or Firm*—Ralph E. Clarke, Jr.

[57] ABSTRACT

A color cathode ray tube comprises an envelope including a faceplate portion having on an inner surface a pattern of cathodoluminescent phosphors deposited thereon. The envelope includes a continuous peripheral support surface within the envelope spaced approximately a predetermined distance from the inner surface of the faceplate. The tube has a tensed foil aperture mask cemented to the support surface by cement means. The mask blank has a first field of apertures in coordinate relationship to the pattern of cathodoluminescent phosphors for color selection. A second field of apertures peripheral to the first field, and coordinate with the support surface, provides for receiving cementing means during assembly of the blank into a cathode ray tube. The apertures have the form of a band of substantially uniform width at least along the sides of the blank, and are small in diameter relative to the width of the band. Tabs extending from the sides of the blank are used for tensing the blank, and are separable from the blank at parting lines. Tear perforations located on the parting lines provide for tearing the tabs from the mask blank upon installation.

4 Claims, 6 Drawing Figures

FIG. 3
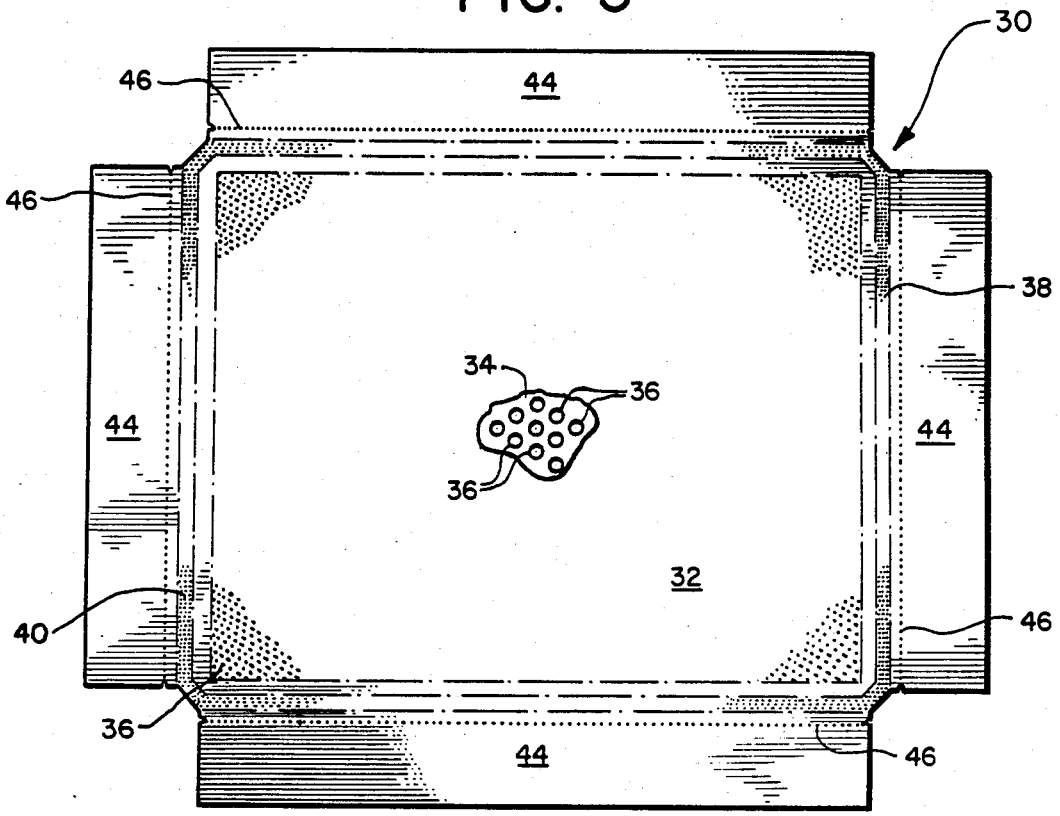
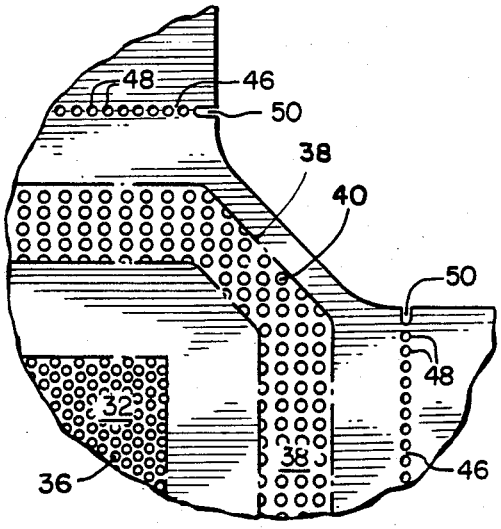
FIG. 4
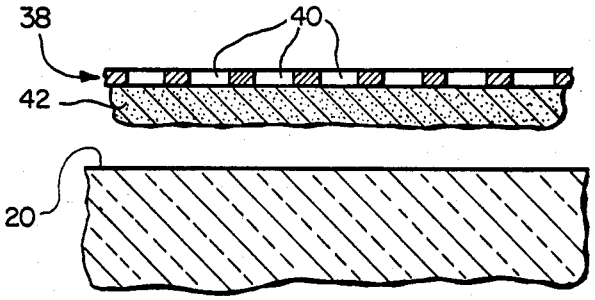
FIG. 5a
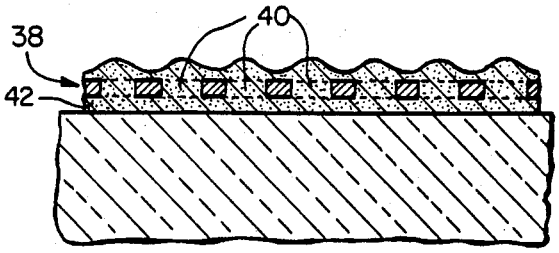
FIG. 5b

COLOR CATHODE RAY TUBE AND TENSIBLE SHADOW MASK BLANK FOR USE THEREIN

CROSS-REFERENCE TO RELATED PATENT APPLICATIONS

This application is related to but in no way dependent upon copending applications Ser. Nos. 538,001 and 538,003, both filed Sept. 30, 1983; Ser. Nos. 572,088 and 572,089 both filed Jan. 18, 1984; and Ser. Nos. 646,861 and 646,862, both filed Aug. 31, 1984; all of common ownership herewith.

BACKGROUND OF THE INVENTION AND DISCUSSION OF PRIOR ART

This invention is concerned with color cathode ray tubes and a tensible shadow mask therefor. A shadow-mask type color cathode ray tube normally comprises an evacuated envelope having a faceplate hermetically sealed to a funnel which terminates in a narrow neck that contains a plural-beam electron gun. The faceplate has on its inner surface a mosaic of discrete deposits of phosphors which emit red, green, and blue light when excited by the respective ones of the three beams of an electron gun. Each beam must fall only upon its assigned discrete phospor deposit. The mechanism that causes the beams to fall only upon the assigned targets is the "shadow mask," which is also known as a "color selection electrode." The mask is located between the beam source and the faceplate and spaced a predetermined distance from the faceplate, a spacing commonly termed the "Q-distance." The mask has a pattern of apertures which may be in the form of circular holes or elongated slots. The apertures are so arranged as to allow the respective beams to fall only on the assigned deposits. The mask does this by blocking out, or "shadowing," unassigned ones of the beams. Thus the "red" beam will fall only upon the red-light-emitting phosphor deposits, the "blue" beam only upon the blue-light-emitting deposits, etc.

The conventional shadow mask is typically a domed sheet of cold-rolled steel. The curves of the dome conform generally to the similarly domed contour of the closely associated faceplate. The mask assembly is usually supported by three or more springs which attach the mask to a skirt on the faceplate by means of studs extending from the skirt. The support means is designed so that the mask can be repeatedly removed and reinstalled in exact prior relationship—a facility required by the faceplate screening process. Masks of this type have a rigid frame that helps to maintain their contour, and provides for suspending the mask by the spring means described. Such masks are largely self-supporting in that the contour of the mask is maintained by the domed configuration and the relative thickness of the mask material—typically in the range of 5 to 10 mils. A grave disadvantage inherent in such a configuration is the tendency of the mask to buckle or bulge in "highlight" areas of the picture. The intensity of the electron beams in high light areas can cause intense heating and a localized expansion of the mask material. The heated portion of the mask is thus displaced from its original position and the color purity of the image is degraded.

In conventional shadow mask systems, which are not under tension, localized doming and consequent color degradation can be reduced by using a thicker mask material. Doming can also be prevented by using a very thin mask material—two mils or less—with the mask under tension. When a thin mask, also known as a "foil mask" is under tension, it will not dome or otherwise deform until heating under electron beam bombardment reaches a critical point. The electronic circuits are designed however so that the critical point is never reached. There have been a number of disclosures of tensed foil masks and means for applying and maintaining mask tension. Typical of these is the disclosure of Law in U.S. Pat. No. 2,625,734, which addresses the construction of a taut, planar, foraminous mask, and the mounting of the mask and target (the faceplate) as a unitary assembly within the envelope. The thin metal is clamped in a frame, and the mask is heated and placed under screw tension. Upon cooling, the metal contracts and is thus rendered taut and held in tension by the frame.

In Pat. No. 1,163,495(GB), a multitude of narrow tabs preferably a fraction of a millimeter wide are shown as extending from a thin metal sheet intended as a shadow mask. The object is to provide means whereby such a thin sheet can be fixed in place without the need for a heavy frame. The sheet is placed under tension and the tabs are said to maintain a constant, uniform tension. The mask is attached directly to the glass of the envelope by the tabs, the ends of which are sealed into the glass.

U.S. Pat. No. 4,069,567 sets forth a method of installing a tensed color selection electrode in a color cathode ray tube. The electrode is held by a holder in a hypertensed state. The electrode and the holder are heated as by an oven while the electrode is tensed. The electrode is heated to a higher temperature than the holder by resistance heating, or RF heating. The electrode is then fixed to the holder and the electrode and holder are cooled to room temperature. The captivated electrode remains in a hypertensed state because its thermal coefficient of expansion is greater than that of the holder.

In U.S. Pat. No. 2,654,940, a wire mesh screen is describedin which the screen is placed over a ring resting on a base, and another, larger ring is placed therearound. The peripheral portion of the screen is thus sandwiched between the two rings to obtain a preliminary tightness of the screen. Final tautness of the screen is achieved by utilizing the difference in the thermal coefficients of expansion of the mask and its mounting.

In U.S. Pat. No. 2,842,696 to Fischer-Colbrie, there is disclosed a color cathode ray tube having an internal ledge in the faceplate skirt for receiving a color selection electrode of the grid wire type. The grid wires are bonded to the ledge in spaced adjacency to the faceplate.

U.S. Pat. No. 3,894,321, of common ownership herewith, discloses a foil mask having a central area of apertures for color selection, and an outer sealing area perforated with a plurality of openings through which frit sealing material can flow. The unperforated area between is said to act as an electron shield.

Other prior art of relevance comprises U.S. Pat. Nos. 2,761,990; 3,440,469; 3,638,063; 3,873,874; and 4,495,437.

OBJECTS OF THE INVENTION

It is a general object of the invention to provide an improved shadow mask component for use in the manufacture of color cathode ray tubes.

It is a more specific object of the invention to provide a color cathode ray tube with an improved shadow mask of the foil type, and with a configuration that provides enhanced image resolution.

It is a specific object of the invention to provide an improved tensible shadow mask blank to facilitate the manufacture of color cathode ray tubes that utilize flat foil shadow masks.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 3 is a plan view of a shadow mask blank according to the invention;

FIG. 4 is a plan view showing in enlarged detail a section of the shadow mask blank shown by FIG. 3; and FIGS. 5A and 5B are elevational views of a section of a shadow mask mounting area showing before and after views of a mask-cementing cycle.

DESCRIPTION OF THE PREFERRED EMBODIMENT

A color selection electrode assembly 10 for use in a color cathode ray tube 12 is shown by the Figures. Various features of the illustrated color cathode ray tube embodying the present invention are described and claimed in various copending applications of common ownership herewith, including applications Ser. Nos. 538,001 and 538,003; 572,088 and 572,089; and 64 6,861 and 646,862.

Figure 1:
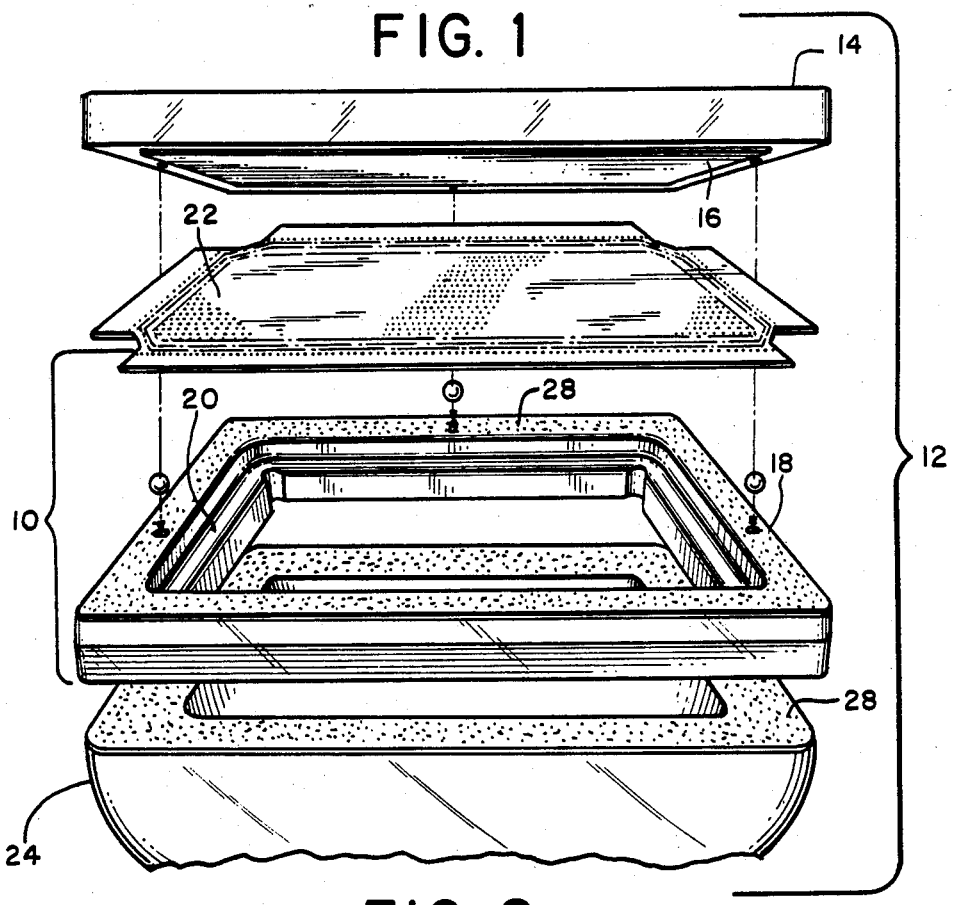
FIG. 1 is an exploded view in perspective of a tensible shadow mask shown in relation to the faceplate, a mounting frame, and the funnel of a cathode ray tube envelope.

The cathode ray tube 12, which is shown only partially by FIG. 1, includes a glass faceplate 14 having a predetermined pattern of phosphor areas deposited upon an inner target surface 16. The assembly is shown as including frame means 18 which has a recessed support surface 20. The support surface 20 supports a foil shadow mask 22 in a tensed state. The shadow mask 22 and its installation in the color selection electrode assembly 10 comprises a utilization of a shadow mask blank according to the invention.

Figure 2:
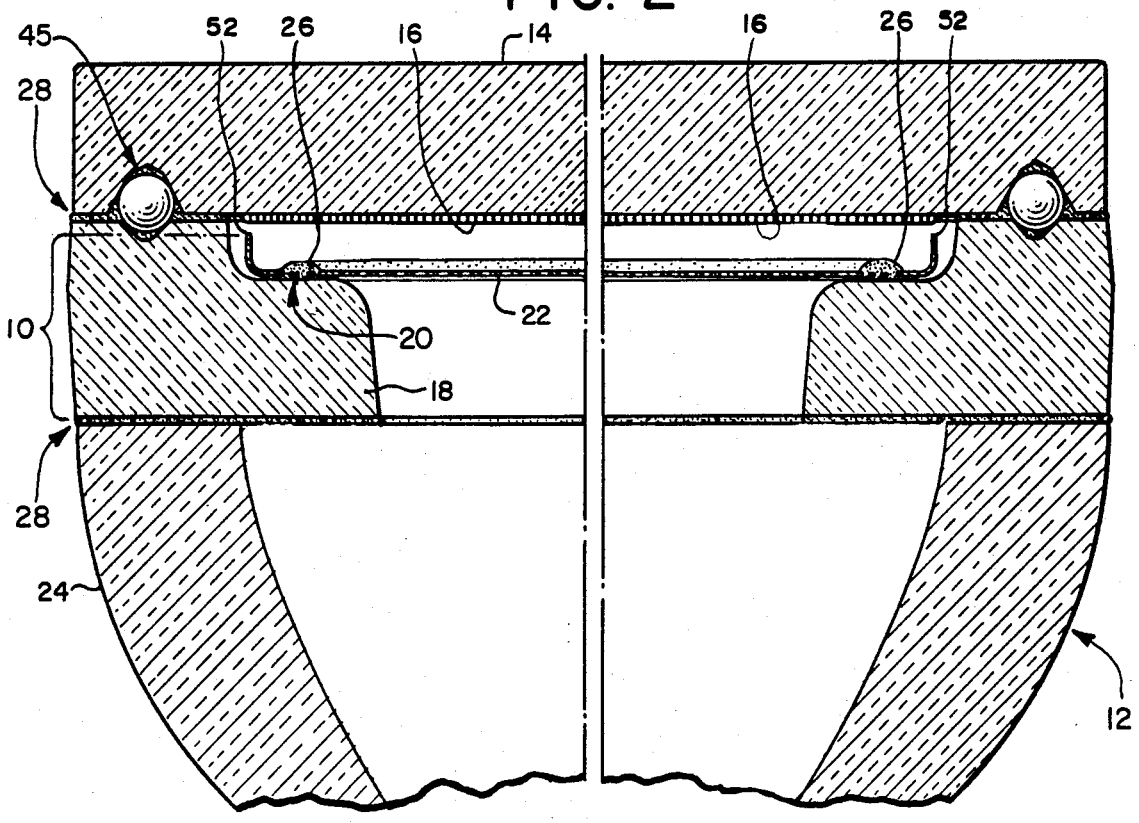
FIG. 2 is a sectional view in elevation revealing details of the relationship of the faceplate, shadow mask, and funnel shown by FIG. 1.

FIG. 2 shows the components described in the foregoing as being assembled in mating relationship. Indicated in sealed attachment are the faceplate 14 to frame means 18, and frame means 18 to the funnel 24 of tube 12. As is well known in the art, the funnel of a conventional cathode ray picture tube terminates in a narrow neck section in which is contained a plural-beam electron gun (not shown). The envelope of the tube is hermetically sealed and evacuated.

The foil shadow mask 22 is shown in FIG. 2 as being cemented to a continuous peripheral recessed support surface 20 by cementing means 26 which also maintain the mask in tension. The support surface 20 is spaced a predetermined distance from the target area 16 of faceplate 14; this spacing is known as "the Q-distance". The Q-distance is defined as the operative distance between the target surface 16 of faceplate 14 and the shadow mask 22. The shadow mask 22 has an array of apertures therein (shown by FIG. 3) related to the predetermined pattern of phosphor areas in the target surface 16. The means for sealing the color selection electrode assembly 10 between the faceplate 14 and the rear envelope section serves to incorporate the color selection electrode assembly 10 as an integral part of the cathode ray tube 12. The sealing means 28 for sealing the color selection electrode assembly 10 and the rear section of the tube envelope is such as to cause the electrode assembly to become an integral component of the envelope when sealed therein. The sealing means 28 may comprise a devitrifying glass cement known as "frit" which is comonly employed in the fabrication of glass cathode ray tubes. A suitable frit is available from Owens-Illinois, Inc. under the designation CV-130.

With reference to FIGS. 3 and 4, there is shown a shadow mask blank 30 according to the invention for use in a color cathode ray tube. Shadow mask blank 30, which is tensible, is shown as having a first field 32 of apertures central to blank 30 for color selection. Mask thickness preferably is in the range of 0.0005 inch to 0.002 inch, and most preferably, about 0.0005 inch. A section 34 of the mask shows the apertures 36, indicated as being substantially circular, in greatly enlarged form. By way of example, the shadow mask aperture diameter may be 0.0035 inch. The "pitch" (distance between aperture centers) for use in a high resolution display may be, for example, 0.3 millimeters (about 0.012 inch), and for very high resolution, 0.2 mm (about 0.008 inch).

Referring again to the Q-distance, this measurement is a function of the pitch of the shadow mask. For example for a given gun design, if the pitch is 0.3 mm, the Q-distance is, by way of example, 0.320 inch. For the very high resolution pitch of 0.2 mm, the Q-distance is preferably 0.210 inch.

The shadow mask blank 30 according to the invention is shown as having in an aspect of the invention, a second field of apertures 38 peripheral to the first field of apertures 32. Second field 38 has the form of a band of substantially uniform width at least along the sides of the blank. The apertures 40 of the second field 38 are small in diameter relative to the width of the band, and are coincident with the support surface for receiving cementing means during assembly of the blank into a cathode ray tube. The size of the apertures 40, which are small in diameter relative to the width of the band, is such as to pass cement in its viscous state when the cement is deposited on only one side of the second field 38 of mask 30. This aspect of the invention is shown by before-and-after FIGS. 5A and 5B in which a bead of viscous cement 42 is shown in FIG. 5A as having been applied to only the side of the field 38 underlying apertures 40, which are sized in the range of 10 to 22 mils, and preferably 16 mils. When the mask 30 is pressed toward the support surface 20, the cement-passing apertures 40 will pass the cement 42 in its viscous state, as indicated in FIG. 5B. The cement could as well be applied to the support surface 20 rather than to the mask 38; if this is done, the cement-passing apertures 40 according to the invention will also pass the cement. The benefit of one-side-of-the-mask application of cement according to the invention is one less step in the process of manufacturing a cathode ray tube, and a substantial saving in the amount of cement that must be used.

The cementing means, described as being "viscous," may be the aforedescribed glass frit in the viscous state, which is its condition prior to the heating process and the consequent devitrification and hardening—a condition in which the cementing and sealing becomes permanent.

The tensible shadow mask blank 30 according to an aspect of the invention is also characterized by having tabs 44, shown as being four for exemplary purposes, extending from the sides of blank 30. The tabs 44 are separable from the blank 30 at parting lines 46. With reference to the detail view in FIG. 4, parting lines 46 are shown as having, according to this aspect of the invention, a plurality of tear perforations 48 on parting lines 46 for tearing tabs 44 from the mask blank 30. To facilitate tearing the tabs 44 from the mask blank 30, tear starters 50 may be indented into the mask material. By way of example, the diameter of each tear perforation is preferably about 16 mils, and the width of the tear starter indent can also be 16 mils. The tear perforations 48 according to this aspect of the invention are useful in production as they provide for quick and easy removal of the tabs without the need for mechanical shearing, for example. The tear perforations are especially valuable when the mask is installed in a recess, a condition shown by FIG. 2. Reference No. 52 shows the point of parting of the tab from the mask; the difficulty in removing the tabs at a recessed parting line by other means will be appreciated.

The tabs 44 comprise extensions of the blank 30 for grasping by a clamping fixture (not shown) which may be used for pretensing the blank. Pre-tensing is relied upon to remove superficial wrinkles from the blank that could affect final tautness if allowed to remain. The blank can be pre-tensed by means of clamps affixed to the four tabs for tensing the mask in all directions. Pre-tensing is usually maintained until the blank is firmly anchored on the support surface by the cementing means.

With reference to FIG. 2, in the preferred embodiment, the tensible shadow mask blank according to the invention is shown as being installed on recessed support surface 20 of frame means 18. This installation into a recess can involve the use of a mandrell (not shown) in the general shape of the recess over which the mask is pre-tensed. Cementing means are applied to the apertures 40 of the second field 38 (or to the recess) as described heretofore, and the mask is inserted into and against the recess, forcing the cementing means through the apertures 40 of the second field 38. If a devitrifying frit is used as the cementing means, the color selection electrode assembly and the mandrell will then be heated to the temperature at which the frit devitrifies and hardens. A differential in the thermal coefficients of expansion of mask and frame may then act to apply the final tension to the mask.

While particular aspects of the invention have been shown and described, it will be apparent to those skilled in the art that changes and modifications may be made without departing from the invention in its broader aspects. For example, the diameter of the apertures 36 in the blank 30, described as preferably being about 0.0035 inch, may be greater or lesser in size depending upon the design requirements. Also, the apertures 36 of the first field 32 may be other than circular, such as oval, or of a slot configuration. Similarly, the apertures 40 in the second field 38, and the tear perforations 48 in the tear strips, may be other than circular and, for example, may be of dimensions that are compatible with the mask blanks intended for use in larger cathode ray tubes.

Regarding the one-side-of-the-mask application of cement, as noted, the cement could as well be applied to both sides of blank 30 over the second field 38 of cement-passing apertures. Although this would mean one or more extra steps in the process of mounting the blank, the result could be greater firmness in anchoring the blank to the support surface—a desired condition if the tube is intended for use in a high stress environment, for example.

The aim of the appended claims is to cover these and all other changes and modifications that fall within the true spirit and scope of the invention.

What is claimed is:

1. A rectangular shadow mask blank for use in a color cathode ray tube comprising:

a first field of apertures central to said blank for color selection;

a second field of apertures peripheral to said first field and substantially uniformly spaced therefrom and having the form of a band of substantially uniform width at least along the sides of said blank, said apertures being small in diameter relative to said width and adapted to receive viscous cementing means during assembly of the blank into a cathode ray tube;

tabs extending from the sides of said blank for use in tensing said blank and separable from said blank at parting lines.

2. A tensible shadow mask blank for use in a color cathode ray tube comprising:

tabs extending from the sides of said blank for use in tensing said blank and separable from said blank at parting lines;

a first field of apertures central to said blank for color selection;

a second field of apertures peripheral to said first field and substantially uniformly spaced therefrom and having the form of a band of substantially uniform width at least along the sides of said blank, said apertures being small in diameter relative to said width and adapted to receive viscous cementing means during assembly of the blank into a cathode ray tube;

tear perforations located on said parting lines for tearing said tabs from said mask blank.

3. The shadow mask blank according to claim 2 wherein said size of said apertures in said second field is such as to pass cement in its viscous state when said cement is deposited on only one side of said second field.

4. A tensible shadow mask blank for use in a color cathode ray tube comprising:

tabs extending from the sides of said blank for use in tensing said blank, and separable from said blank at parting lines;

a field of apertures central to said blank for color selection;

tear perforations located on said parting lines for parting said tabs from said blank.

* * * * *